US010612431B2

(12) United States Patent
Mlinaric

(10) Patent No.: US 10,612,431 B2
(45) Date of Patent: Apr. 7, 2020

(54) TEMPERATURE INDEPENDENT CAMSHAFT PHASER ACTUATION STRATEGY

(71) Applicant: Schaeffler Technologies AG & Co. KG, Herzogenaurach (DE)

(72) Inventor: Andrew Mlinaric, Tecumseh (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/908,868

(22) Filed: Mar. 1, 2018

(65) Prior Publication Data

US 2018/0252123 A1 Sep. 6, 2018

Related U.S. Application Data

(60) Provisional application No. 62/466,508, filed on Mar. 3, 2017.

(51) Int. Cl.

| | |
|---|---|
| ***F01L 1/344*** | (2006.01) |
| ***F01L 1/047*** | (2006.01) |
| ***F01L 9/02*** | (2006.01) |

(52) U.S. Cl.

CPC ..... *F01L 1/3442* (2013.01); *F01L 1/047* (2013.01); *F01L 9/02* (2013.01); *F01L 2001/34469* (2013.01); *F01L 2001/34473* (2013.01); *F01L 2001/34483* (2013.01); *F01L 2101/00* (2013.01); *F01L 2800/00* (2013.01); *F01L 2800/01* (2013.01); *F01L 2820/01* (2013.01); *F01L 2820/02* (2013.01)

(58) Field of Classification Search

CPC ..... F01L 2001/3443; F01L 2001/34469; F01L 2800/00; F01L 2800/16

USPC ..... 123/90.17

See application file for complete search history.

(56) References Cited

U.S. PATENT DOCUMENTS

| | | | | |
|---|---|---|---|---|
| 6,330,870 | B1 | 12/2001 | Inoue et al. | |
| 6,477,996 | B2 | 11/2002 | Ogawa | |
| 6,505,586 | B1 | 1/2003 | Sato et al. | |
| 2004/0003788 | A1* | 1/2004 | Taylor | F01L 1/022 123/90.15 |
| 2005/0201036 | A1* | 9/2005 | Santero | F01L 1/344 361/152 |
| 2010/0139593 | A1 | 6/2010 | Takemura | |
| 2014/0244141 | A1* | 8/2014 | Strehlau | F02D 41/062 701/113 |

(Continued)

*Primary Examiner* — Jorge L Leon, Jr.

(57) ABSTRACT

A method of operating a cam shaft phaser including a stator including a radially inwardly extending protrusion, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a pin disposed in the slot, and a first channel connecting the chamber with the slot. The method comprises: blocking, with the locking pin, rotation of the rotor with respect to the stator; applying pulse width modulation voltage to a control valve as a non-rectangular wave form; flowing fluid from the control valve to the chamber; flowing the fluid through the first channel to the slot; axially displacing the locking pin with the fluid; disengaging the locking pin from the cover; and rotating the rotor with respect to the stator.

18 Claims, 13 Drawing Sheets

(56) References Cited

U.S. PATENT DOCUMENTS

2016/0108774 A1* 4/2016 Pietrzyk ..... F01L 1/34409
123/90.1

* cited by examiner

TEMPERATURE INDEPENDENT CAMSHAFT PHASER ACTUATION STRATEGY

CROSS-REFERENCE TO RELATED APPLICATIONS

This application claims the benefit under 35 U.S.C. § 119(e) of U.S. Provisional Application No. 62/466,508 filed on Mar. 3, 2017 which application is incorporated herein by reference.

TECHNICAL FIELD

The present disclosure relates to a method of operating a cam shaft phaser including a locking pin. In particular, a method of applying pulse width modulation voltage to a control valve supplying fluid to the cam shaft phaser as a non-rectangular wave form to displace the locking pin.

BACKGROUND

The discussion that follows uses cam shaft phaser 100 in FIGS. 1 through 5 as an example. Pin 120 is used to lock rotor 104 to stator 102 for a locked mode for phaser 100 as further described below. To transition from the locked mode to an unlocked mode for phaser 100, fluid F, for example oil, flows to chamber 114A and through channel 126 to displace pin 120 out of indentation 124. If fluid F flows too quickly to chamber 114A: rotor 104 urges pin 120 in direction CD1 before pin 120 has disengaged from cover 106 to jam, or wedge, pin 120 against cover 106; and rotor 104 is unable to rotate to a desired unlocked position for the unlocked mode.

As is known in the art, control valve CV includes one or more electrical elements, such as solenoids, that are energized to control flow of fluid to chambers 114 and 116. The force generated by the electrical elements determines the flow of fluid F to chambers 114 and 116. The force generated by the electrical elements is dependent on the current applied to valve CV and the current subsequently flowing through the electrical elements. The current is dependent upon the resistance of the material forming the elements, for example copper coils, and the voltage applied to the elements, as shown by Ohm's law: I (current)=V (voltage)/R (resistance). Voltage is typically controlled with the use of pulse width modulation (PWM). Resistance of the material is temperature dependent. For example, as temperature of the material increases, so does the resistance. For example, for copper, a temperature difference of 50° C. results in a 20% change in R. Therefore, the function of the solenoids and the flow of fluid F is temperature dependent.

FIG. 11A is a graph of fluid flow versus electrical current for a known method of operating a known cam shaft phaser with an axially displaceable locking pin. FIG. 11B is a graph of pulse width modulation (PWM) voltage versus electrical current for the cam shaft phaser of FIG. 11A. As is known in the art, in FIG. 11A, at zero current, fluid flow is at a maximum to chambers 116 through channels 132. As the current increases, fluid flow to chambers 116 is decreased and the flow is substantially terminated at electric current level 602. As the current level is increased beyond level 602, fluid flow begins to flow to chambers 114. The ideal flow rate of fluid F to chamber 114A occurs at current level 604 and point 606 on oil flow curve 608. That is, for level 604, flow rate 610 for fluid F is enough to flow fluid F from chamber 114A to slot 118 through channel 126 and displace pin 120 out of indentation 124. That is, flow rate 610 does not urge rotor 104 in direction CD1 with sufficient force to jam pin 120 against cover 106 and prevent pin 120 from displacing out of indentation 124.

FIG. 11B illustrates the temperature dependency of point 606. Line 702 is for a first ambient temperature of the material, described above, for the electrical elements. PWM voltage level 704 is needed to generated ideal current level 604. Line 706 is for a second ambient temperature of the material, described above, for the electrical elements. The second temperature is greater than the first temperature; therefore, PWM voltage level 708, greater than voltage level 704, is needed to generated ideal current level 604. PMW voltage is the only input to control valve CV. As further described below, known methods of operating a cam shaft phaser, such as phaser 100, involve the use of a same PWM level regardless of ambient temperature and these methods are not effective at all the ambient temperatures that can be expected for control valve CV.

FIG. 12A is a graph of the duty cycle of PWM voltage versus time for a known method of operating a known cam shaft phaser with an axially displaceable locking pin. FIG. 12A is a graph of measured angle versus time for the known method of operating the known cam shaft phaser of FIG. 12A. For the known method associated with FIGS. 12A and 12B, At time t9, controller C activates power supply PS to transmit PWM voltage, as a rectangular wave form, to control valve CV and initiate the unlocked mode. In FIGS. 12A and 12B, application of the rectangular wave between times t9 and t10 fails to rotate rotor 104 (pin 120 jammed against cover) to the desired unlocked position, for example due to the ambient temperature of control valve CV. For example, rotor 104 has been urged in direction CD1 with sufficient force to jam pin 120 against cover 106 before pin 120 has displaced out of indentation 124. Starting at time t10, a strategy to pulse fluid flow to chamber 114A and slot 118 using a rectangular PWM wave form with duty cycle 802 is employed. The goal of the strategy is break the contact of pin 120 with cover 106 and enable pin 120 to disengage from cover 106. However, the strategy relies on the same duty cycle 802, regardless of temperature, and so is subject to the temperature limitations noted above. Eventually, by time t11, the strategy may be successful. If the strategy is successful, the time span between times t10 and t11 depends on the difference between the actual ambient temperature and the ambient temperature assumed for the pulsing strategy.

SUMMARY

According to aspects illustrated herein, there is provided a method of operating a cam shaft phaser including a stator including a radially inwardly extending protrusion, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a pin disposed in the slot, and a first channel connecting the chamber with the slot. The method includes: blocking, with the locking pin, rotation of the rotor with respect to the stator; applying pulse width modulation (PWM) voltage to a control valve as a non-rectangular wave form; flowing fluid from the control valve to the chamber; flowing the fluid through the first channel to the slot; axially displacing the locking pin with the fluid; disengaging the locking pin from the cover; and rotating the rotor with respect to the stator.

According to aspects illustrated herein, there is provided a method of operating a cam shaft phaser including a stator including a radially inwardly extending protrusion, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a pin disposed in the slot, and a channel connecting the chamber with the slot. The method includes: blocking, with the locking pin, rotation of the rotor with respect to the stator; applying first pulse width modulation (PWM) voltage to a control valve; flowing fluid from the control valve to the chamber; urging, with the fluid, the rotor in a first circumferential direction with respect to the stator; axially fixing the locking pin, through contact of the locking pin with the cover, while the locking pin is blocking rotation of the rotor with respect to the stator; applying second pulse width modulation (PWM) voltage to the control valve as a non-rectangular wave form; flowing the fluid through the channel to the slot; axially displacing the locking pin with the fluid; disengaging the locking pin from the cover; and rotating the rotor with respect to the stator in the first circumferential direction.

According to aspects illustrated herein, there is provided a method of operating a cam shaft phaser including a stator including a radially inwardly extending protrusions, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a pin disposed in the slot, and a first channel connecting the chamber with the slot. The method includes: engaging the cover with the locking pin; blocking, with the locking pin, rotation of the rotor with respect to the stator; applying pulse width modulation (PWM) voltage to a control valve as a non-rectangular wave form; flowing fluid from the control valve to the chamber; flowing the fluid through the first channel to the slot; axially displacing the locking pin with the fluid; disengaging the locking pin from the cover; and rotating the rotor with respect to the stator.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 13:
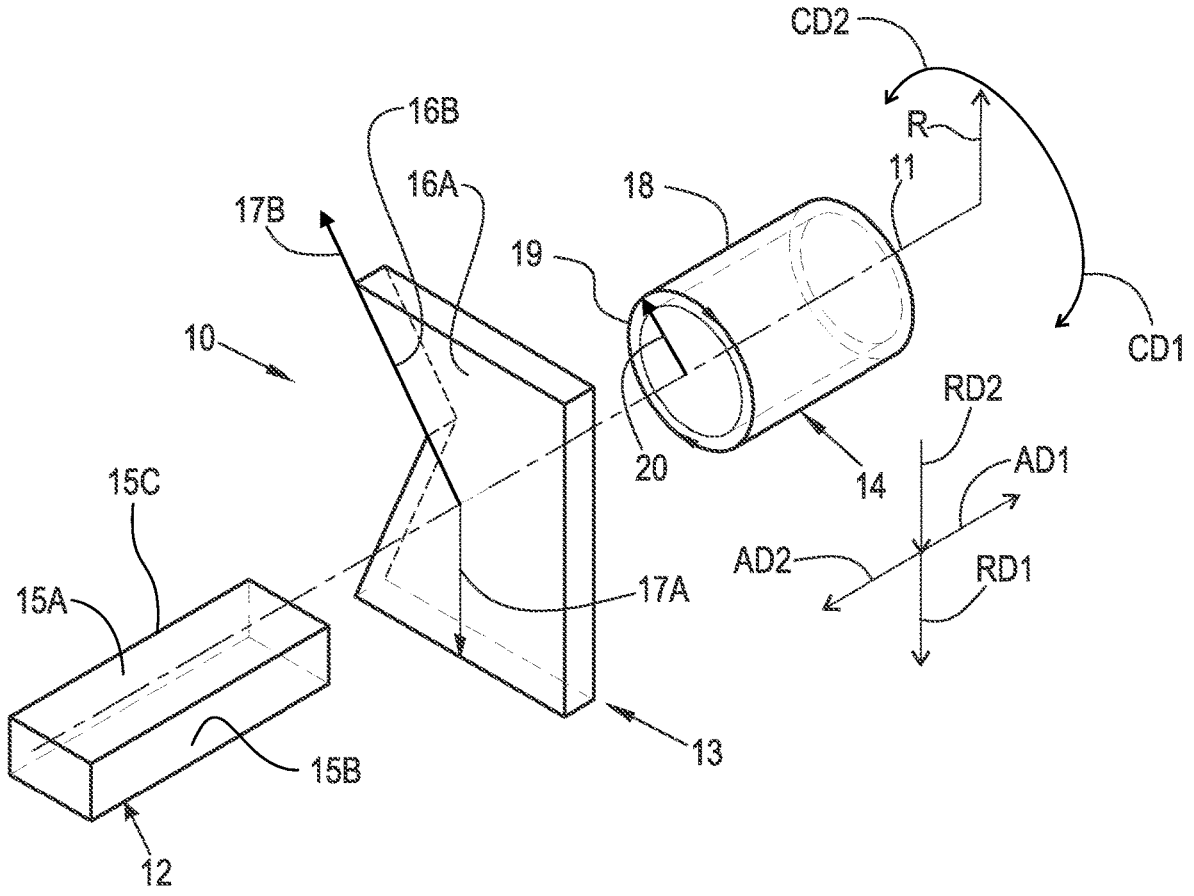
FIG. 13 is a perspective view of a cylindrical coordinate system demonstrating spatial terminology used in the present application.

FIG. 13 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 20, passes through surface 18.

Axial movement is in axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
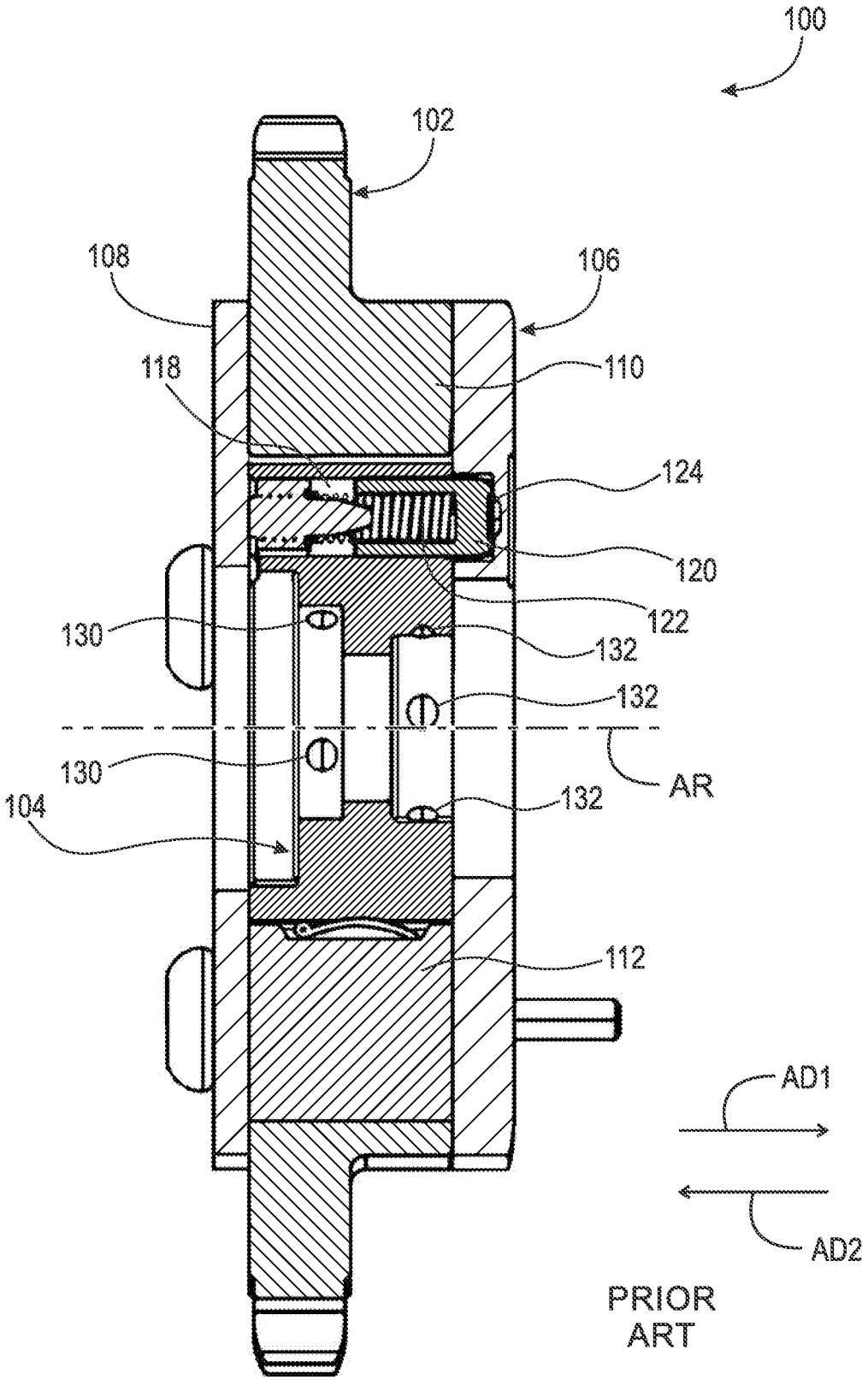
FIG. 1 is a cross-sectional view of a known cam shaft phaser with an axially displaceable locking pin in a locked mode.

FIG. 1 is a cross-sectional view of known cam shaft phaser 100 with an axially displaceable locking pin.

Figure 2:
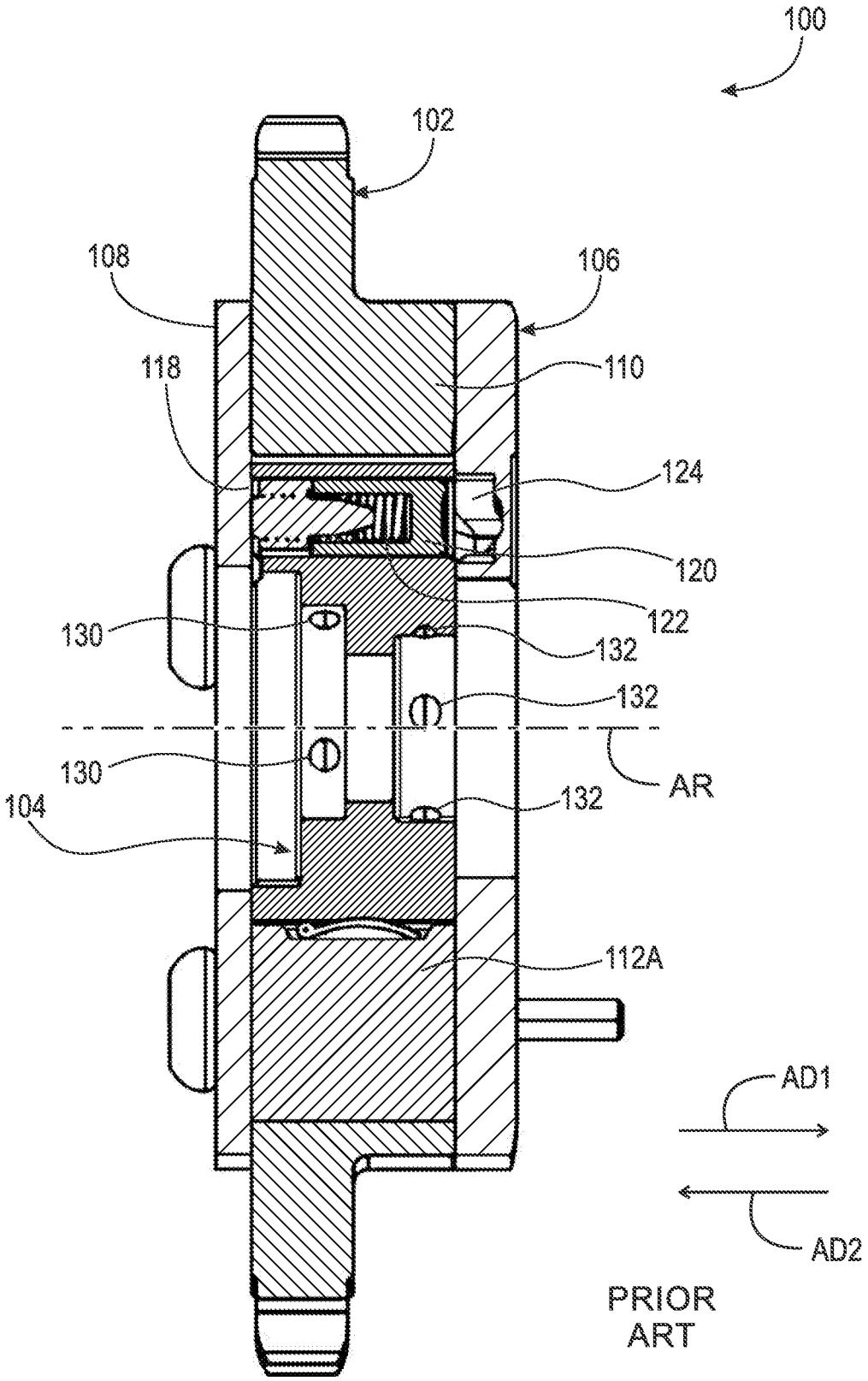
FIG. 2 is a cross-sectional view of the known cam shaft phaser in FIG. 1 in an unlocked mode.

FIG. 2 is a cross-sectional view of the known cam shaft phaser in FIG. 1 in an unlocked mode.

Figure 3:
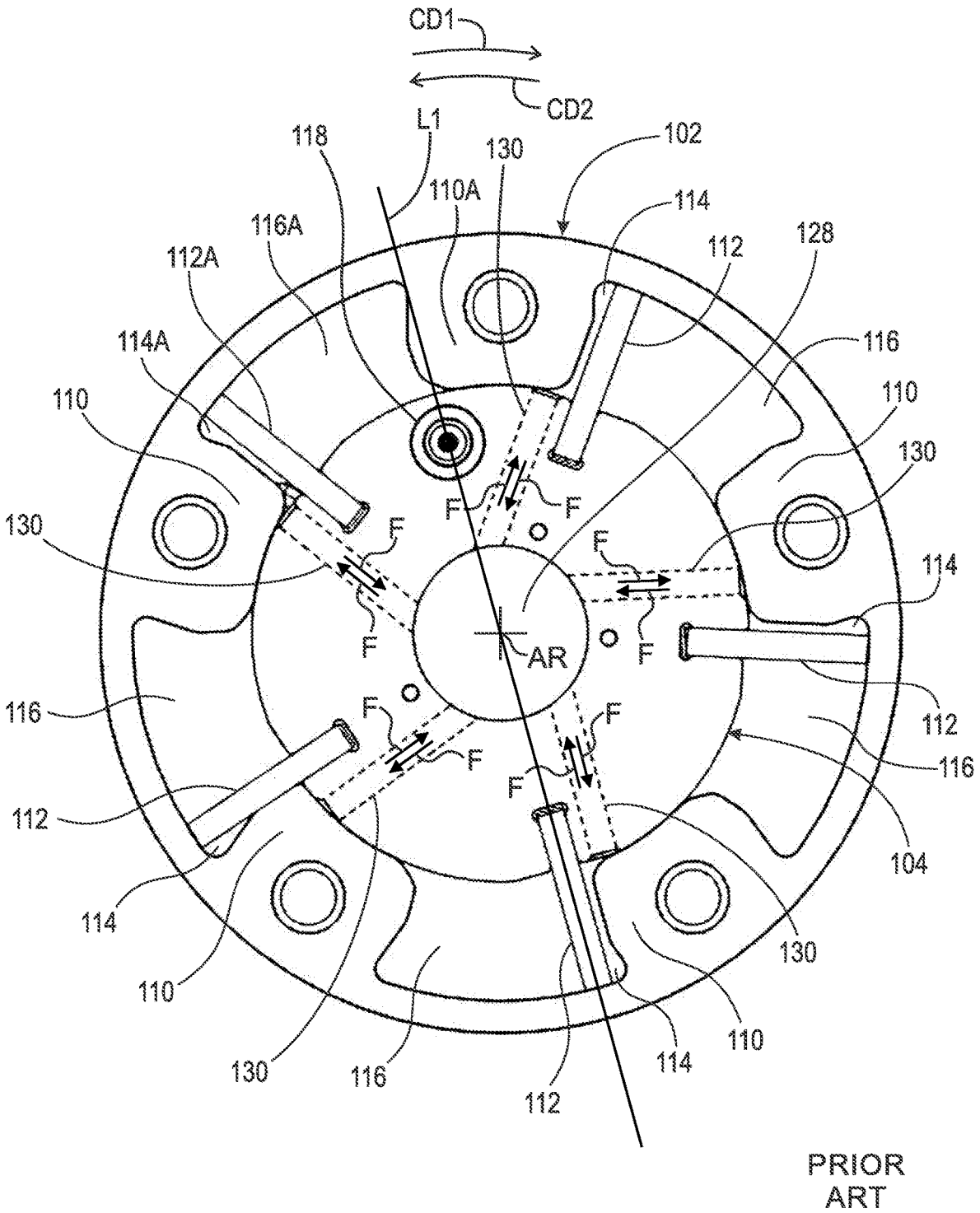
FIG. 3 is a back view of a rotor and stator in FIG. 1.

FIG. 3 is a back view of a rotor and stator in FIG. 1.

Figure 4:
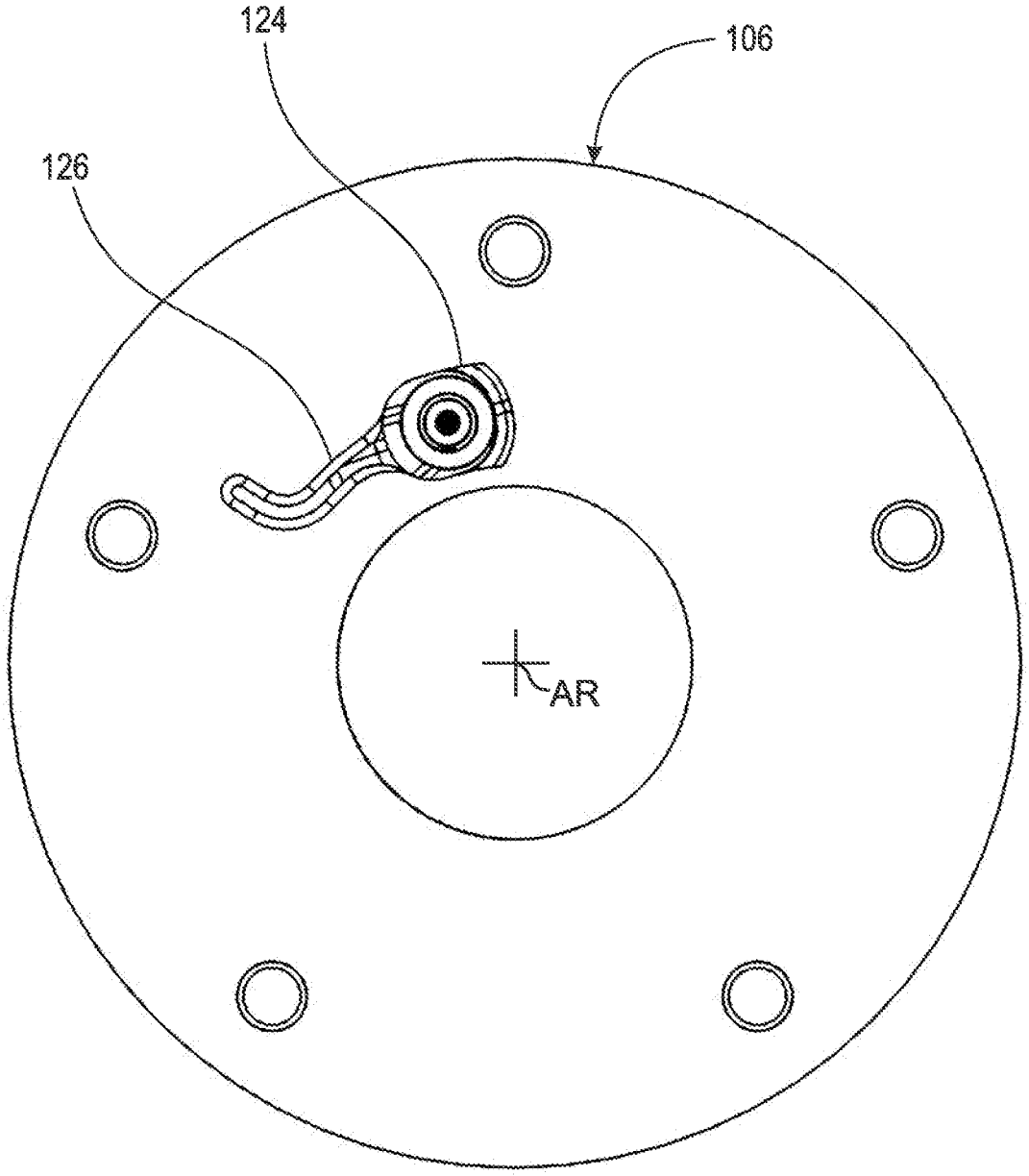
PRIOR ART Fig. 4
FIG. 4 is a back view of a cover in FIG. 1.

FIG. 4 is a back view of a cover in FIG. 1. The following should be viewed in light of FIGS. 1 through 4. Line L1 is a reference line showing the relative position of the cross-sectional view of FIGS. 1 and 2. Cam shaft phaser 100 includes stator 102, rotor 104, cover 106 and cover 108. Covers 106 and 108 are non-rotatably connected to stator 102. Stator 102 includes radially inwardly extending protrusions 110. Rotor 104 includes radially outwardly extending protrusions 112. In the example of FIGS. 1 through 4, pairs of advance chamber 114 and retard chamber 116 are formed by two respective protrusion 110 and a respective protrusion 112. It should be understood that the functionality of chambers 114 and 116 can be reversed, such that chambers 114 are retard chambers and chambers 116 are advance chambers. Rotor 104 includes: slot 118, locking pin 120 and spring 122 urging pin 120 in axial direction AD1. Cover 106 includes indentation 124. Channel 126 connects chamber 114A with slot 118.

Figure 5:
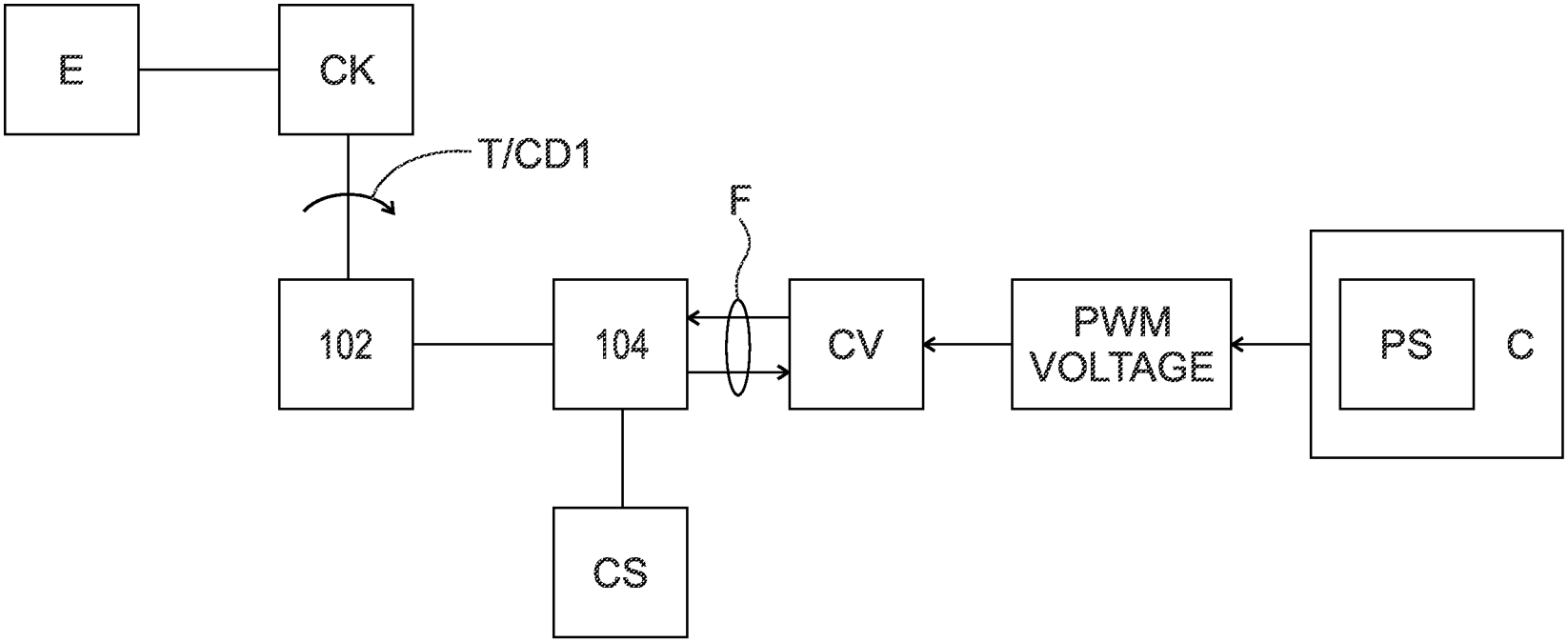
FIG. 5 is a block diagram including the cam shaft phaser in FIG. 1.

FIG. 5 is a block diagram including the cam shaft phaser in FIG. 1. The following should be viewed in light of FIGS. 1 through 5. As is known in the art, stator 102 is arranged to receive rotational torque T from crankshaft CK for engine E in circumferential direction CD1. Thus, stator 102 rotates in direction CD1. Rotor 104 rotates with stator 102. Cam shaft CS, non-rotatably connected to rotor 104, rotates with stator 102. However, as is known in the art, the circumferential position of rotor 104 and cam shaft CS, with respect to stator 102 is modified according to operating conditions for engine E. In the example of FIG. 1: to advance timing for engine E, fluid F is transmitted to chambers 114 and fluid F is drained from chambers 116 to displace protrusions 112 in direction CD1; and to retard timing for engine E, fluid F is transmitted to chambers 116 and fluid F is drained from chambers 114 to displace protrusions 112 in direction CD2. Rotor 104 includes central opening 128, through which axis of rotation AR passes. In an example embodiment: fluid F is transmitted to and drained from chambers 114 by channels 130 in rotor 104 as is known in the art and fluid F is transmitted to and drained from chambers 116 by channels 132 in rotor 104 as is known in the art.

For the locked mode for phaser 100 shown in FIG. 1, upon shut down of engine E, rotor 104 is rotated so that pin 120 aligns with indentation 124 and spring 122 axially displaces pin 120 in axial direction AD1 into indentation 124. Pin 120 blocks rotation of rotor 104 with respect to cover 106 and stator 102 and maintains rotor 104 in the circumferential position shown in FIG. 3. The locked mode is used to position rotor 104 in a known circumferential position for engine start up.

For the unlocked mode for phaser 100 shown in FIG. 2, engine E starts rotating, fluid F flows into chamber 114A and through channel 126 to slot 118. In slot 118, fluid F displaces pin 120 in direction AD2 out of indentation 124, while compressing spring 122. Rotor 104 is then free to rotate with respect to stator 102.

Pulse width modulation (PWM) voltage is used to energize control valve CV to transmit fluid F to chambers 114 and 116. Any means known in the art can be used to supply the PWM voltage. In the example of FIG. 5, controller C includes on-board power supply PS used to supply the PWM voltage. Any means known in the art can be used to transmit fluid F from valve CV to rotor 104.

Figure 6A:
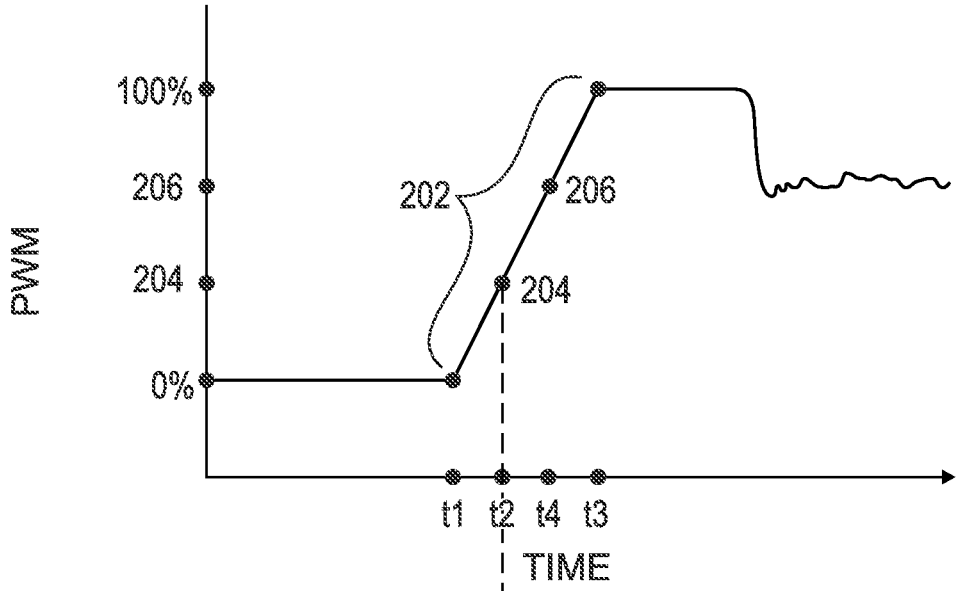
FIG. 6A is a graph of measured angle versus time for operation of a cam shaft phaser with an axially displaceable locking pin.

FIG. 6A is a graph of the duty cycle of PWM voltage versus time for operation of a cam shaft phaser with an axially displaceable locking pin.

Figure 6B:
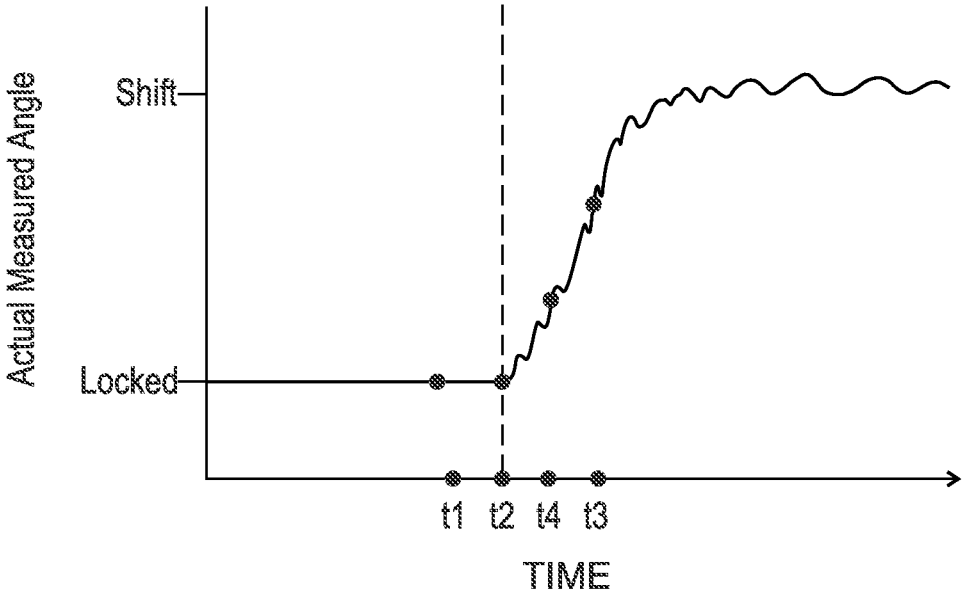
FIG. 6B is a graph of duty cycle of pulse width modulated (PWM) voltage versus time for operation of the cam shaft phaser of FIG. 6A.

FIG. 6B is a graph of measured angle for rotor 104 versus time for operation of the known cam shaft phaser of FIG. 6A. The following should be viewed in light of FIGS. 1 through 6B. In the discussion that follows, cam shaft phaser 100 is used as an example of the cam shaft phaser with the axially displaceable locking pin. FIGS. 6A and 6B begin with phaser 100 in the locked mode. At time t1, controller C activates power supply PS to transmit PWM voltage to control valve CV and initiate the unlocked mode. However, unlike known methods of transitioning from the locked mode to the unlocked mode that supply the PWM voltage as a rectangular wave form (100 percent duty cycle), power supply PS generates the PWM voltage as function 202 for the duty cycle. Function 202 increases with time and is not a rectangular wave form. Function 202 occurs between times t1 and t2. At time t2, the ideal current noted above is reached at point 204. That is, at time t2, the duty cycle for the PWM voltage to control valve CV is such that fluid F is transmitted to chamber 114A and slot 118 to displace pin 120 from indentation 124, without urging rotor 104 in direction CD1 to cause pin 120 to jam against cover 106.

Referring to FIG. 6B, between time t1 and time t2, fluid F is flowing into chamber 114A and through channel 126 to slot 118, without urging rotor 104 in direction CD1 to jam pin 120 against cover 106. Therefore, the angle for rotor 104 remains constant. Following time t2, rotor 104 begins to rotate. Between times t1 and t2, fluid F has displaced pin 120 from indentation 124. Past time t2, the normal operational scheme for phaser 100 is implemented by controller C. In the example of FIGS. 6A and 6B, function 202 is implemented past time t2 to time t3, which corresponds to 100 percent duty cycle. It should be understood that following time t2, the PWM voltage can be provided as function different from function 202. At time t3, the desired angle for rotor 104 has been attained. The duty cycle shown beyond time t3 is a typical example of the PWM voltage duty cycle for the normal operational scheme for phaser 100.

In an example embodiment, the PWM voltage continuously increases for function 202. In an example embodiment, function 202 is a linear function. In an example embodiment, function 202 is a ramp function.

Figure 7:
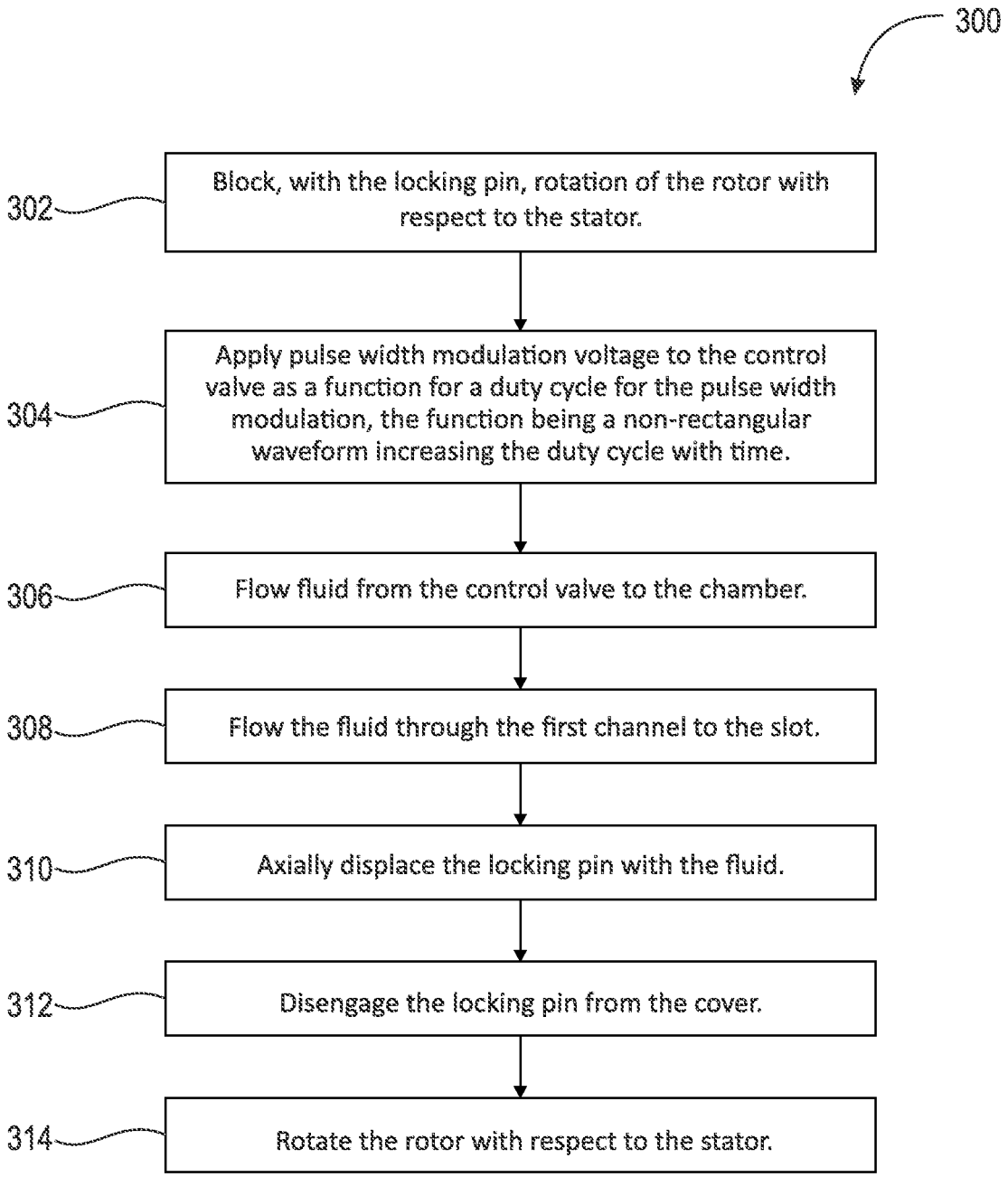
FIG. 7 is a flow chart for a method of operating a cam shaft phaser with an axially displaceable locking pin.

FIG. 7 is flow chart 300 for a method of operating a cam shaft phaser with an axially displaceable locking pin. In the discussion that follows, cam shaft phaser 100 is used as an example of the cam shaft phaser with the axially displaceable locking pin. Although the method is presented as a sequence of steps for clarity, no order should be inferred from the sequence unless explicitly stated. The cam shaft phaser includes: a stator, for example stator 102, including a radially inwardly extending protrusion, for example protrusion 110A; a rotor, for example rotor 104 including a radially outwardly extending protrusion, for example protrusion 112A, and a slot, for example slot 118, in the radially outwardly extending protrusion; a cover, for example cover 106, non-rotatably connected to the stator; a chamber, for example chamber 114A circumferentially bounded by the radially inwardly extending protrusion and the radially outwardly extending protrusion; a pin, for example pin 120, disposed in the slot; and a first channel, for example channel 126, connecting the chamber with the slot. Step 302 blocks, with the locking pin, rotation of the rotor with respect to the stator. Step 304 applies PWM voltage to the control valve as a function for a duty cycle for the PWM, the function being a non-rectangular wave form increasing the duty cycle with time. Step 306 flows fluid from the control valve to the chamber. Step 308 flows the fluid through the first channel to the slot. Step 310 axially displaces the locking pin with the fluid. Step 312 disengages the locking pin from the cover. Step 314 rotates the rotor with respect to the stator. Step 306 flows the fluid at a rate proportional to the duty cycle.

In an example embodiment, a step urges, with a spring, for example spring 122, disposed in the slot, the locking pin in a first axial direction and another step displaces, with the spring, the locking pin in the first axial direction into an indentation, for example indentation 124, in the cover.

In an example embodiment: a step urges, with a spring disposed in the slot, the locking pin in a first axial direction and step 310 includes: displacing the locking pin in a second axial direction opposite the first axial direction; and compressing the spring.

In an example embodiment: a step generates, with a controller, a desired circumferential position of the rotor with respect to the stator; another step disengages the locking pin from the cover at a first point in the function, for example at point 204 at time t2; and a further step rotates the rotor to the desired circumferential position at a second point in the function, for example point 206 at time t3, the second point occurring after the first point in the function.

In an example embodiment: the function continuously increases the duty cycle; or the function is a linear function; or the function is a ramp function.

In an example embodiment: a step initiates the function at a first point for the function; another step terminates the function at a second point in the function; and a further step disengages the locking pin from the cover at a third point in the function between the first and second points. For example, the first, second, and third points in function 202 occur at time t1, t3 and t2, respectively.

In an example embodiment, step 306 flows the fluid through a second channel connecting the chamber with a central opening for the rotor. An axis of rotation for the cam shaft phaser passes through the central opening. For example, step 306 flows fluid F through a channel 130. A step rotates the stator with torque from a crankshaft for an internal combustion engine.

Figure 8:
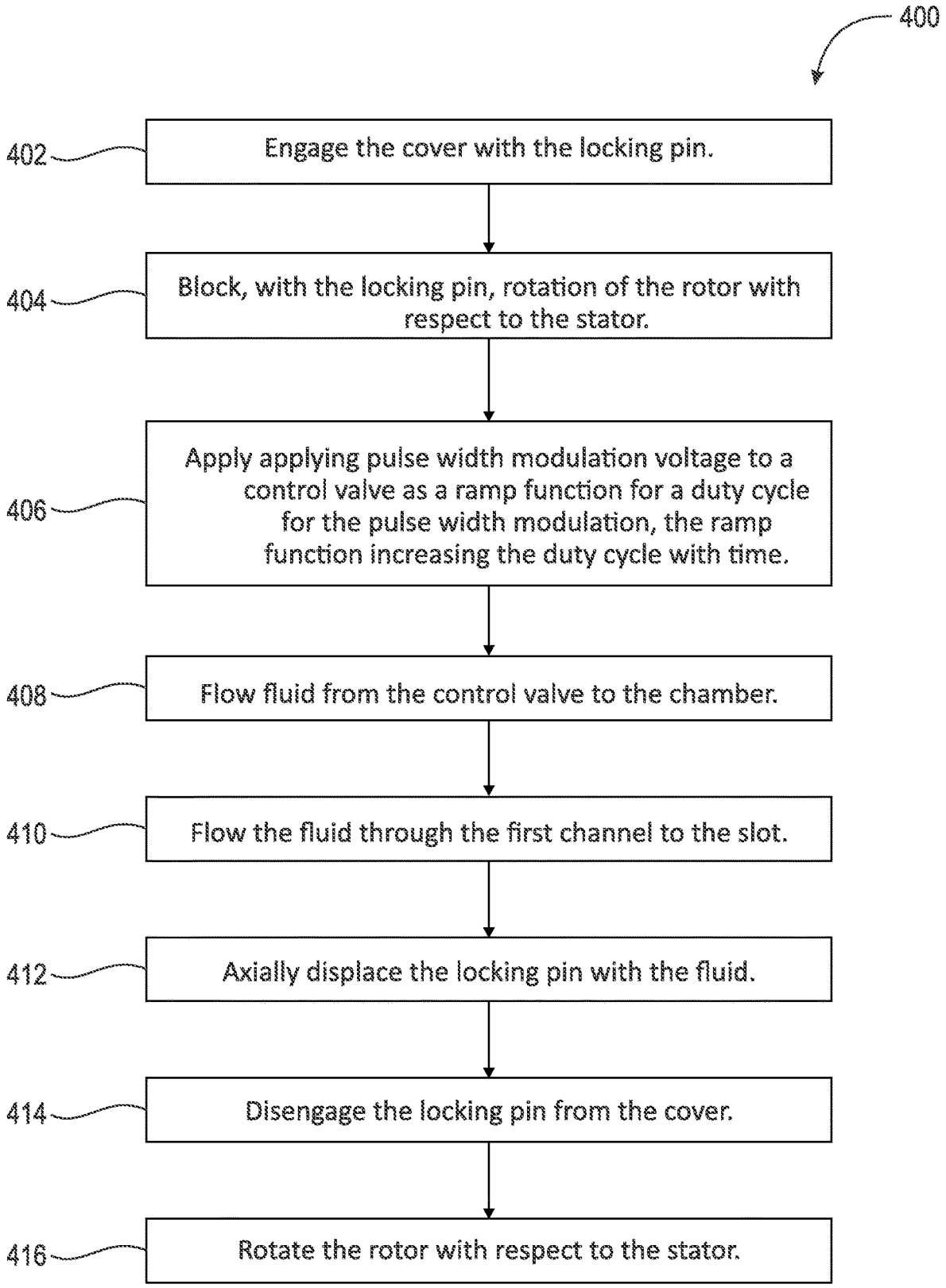
FIG. 8 is a flow chart for a method of operating a cam shaft phaser with an axially displaceable locking pin.

FIG. 8 is flow chart 400 for a method of operating a cam shaft phaser with an axially displaceable locking pin. In the discussion that follows, cam shaft phaser 100 is used as an example of the known cam shaft phaser with the axially displaceable locking pin. Although the method is presented as a sequence of steps for clarity, no order should be inferred from the sequence unless explicitly stated. The cam shaft phaser includes: a stator, for example stator 102, including a radially inwardly extending protrusion, for example protrusion 110A; a rotor, for example rotor 104 including a radially outwardly extending protrusion, for example protrusion 112A, and a slot, for example slot 118, in the radially outwardly extending protrusion; a cover, for example cover 106, non-rotatably connected to the stator; a chamber, for example chamber 114A circumferentially bounded by the radially inwardly extending protrusion and the radially outwardly extending protrusion; a pin, for example pin 120, disposed in the slot; and a first channel, for example channel 126, connecting the chamber with the slot. Step 402 engages the cover with the locking pin. Step 404 blocks, with the locking pin, rotation of the rotor with respect to the stator. Step 406 applies applying PWM voltage to a control valve as a ramp function for a duty cycle for the PWM, the ramp function increasing the duty cycle with time. Step 408 flows fluid from the control valve to the chamber. Step 410 flows the fluid through the first channel to the slot. Step 412 axially displaces the locking pin with the fluid. Step 414 disengages the locking pin from the cover. Step 416 rotates the rotor with respect to the stator.

Figure 9A:
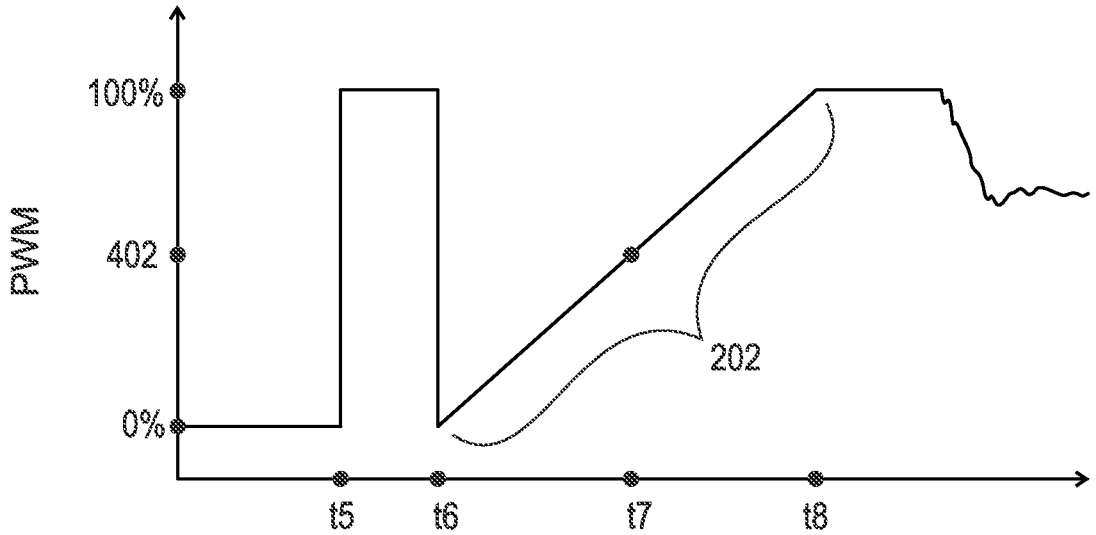
FIG. 9A is a graph of duty cycle of PWM voltage versus time for operation of a cam shaft phaser with an axially displaceable locking pin.

FIG. 9A is a graph of fluid flow versus control valve current for a cam shaft phaser with an axially displaceable locking pin.

Figure 9B:
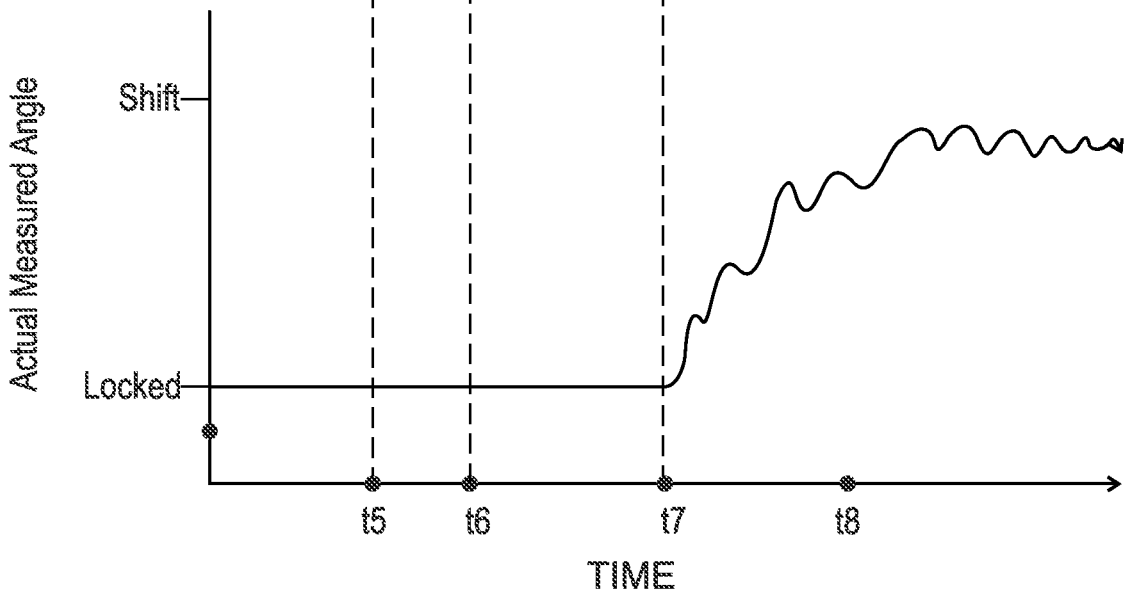
FIG. 9B is a graph of measured angle for a rotor versus time for operation of the cam shaft phaser of FIG. 9A.

FIG. 9B is a graph of pulse width modulation voltage versus current for the cam shaft phaser of FIG. 9A. In the discussion that follows, cam shaft phaser 100 is used as an example of the cam shaft phaser with the axially displaceable locking pin. The following should be viewed in light of FIGS. 1 through 9B. FIGS. 9A and 9B begin with phaser 100 in the locked mode. Between times t5 and t6, controller C activates power supply PS to supply PWM voltage to control valve CV and initiate the unlocked mode using the known method of supplying the PWM voltage as a rectangular wave form. In the example of FIGS. 9A and 9B, rotor 104 has been urged in direction CD1 with sufficient force to wedge pin 120 against cover 106 to prevent pin 120 from disengaging from cover 106. At time t6, controller C determines that the difference between times t5 and t6 is large enough to indicate that pin 120 is stuck. Then, controller C commands power supply PS to supply the PWM voltage as function 202. At time t7, the ideal current noted above is reached at duty cycle 402.

Referring to FIG. 9B, between time t5 and time t6, fluid F is flowing into chamber 114A and urging rotor 104 in direction CD1 to jam pin 120 against cover 106 before fluid F can displace pin 120 from indentation 124. Therefore, the angle for rotor 104 does not shift. Following time t7, pin 120 has displaced out of indentation 124 and rotor 104 begins to rotate. Between times t6 and t7, fluid F has displaced pin 120 from indentation 124 and rotor 104 is not urged in direction CD1 with sufficient force to wedge pin 120 against cover 106. Past time t7, the normal operational scheme for phaser 100 is implemented by controller C. In the example of FIGS. 9A and 9B, function 202 is implemented past time t7 to time t8, which corresponds to 100 percent duty cycle. It should be understood that following time t7, the PWM voltage can be provided as a function different from function 202. At time t8, the desired angle for rotor 104 has been attained. The duty cycle shown beyond time t8 is a typical example of the PWM voltage duty cycle for the normal operational scheme.

Figure 10:
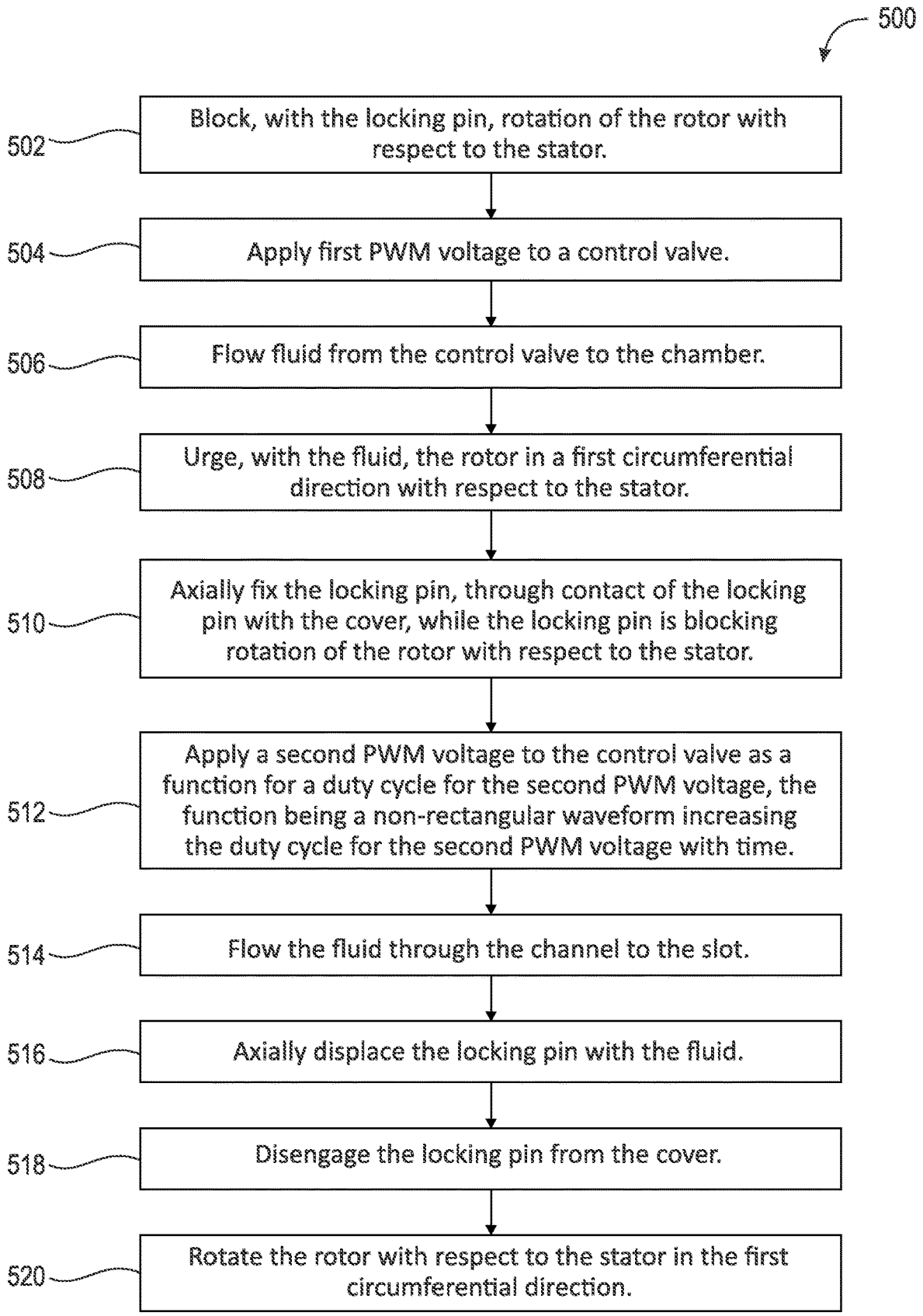
FIG. 10 is a flow chart for a method of operating a cam shaft phaser with an axially displaceable locking pin.
Figure 11A:
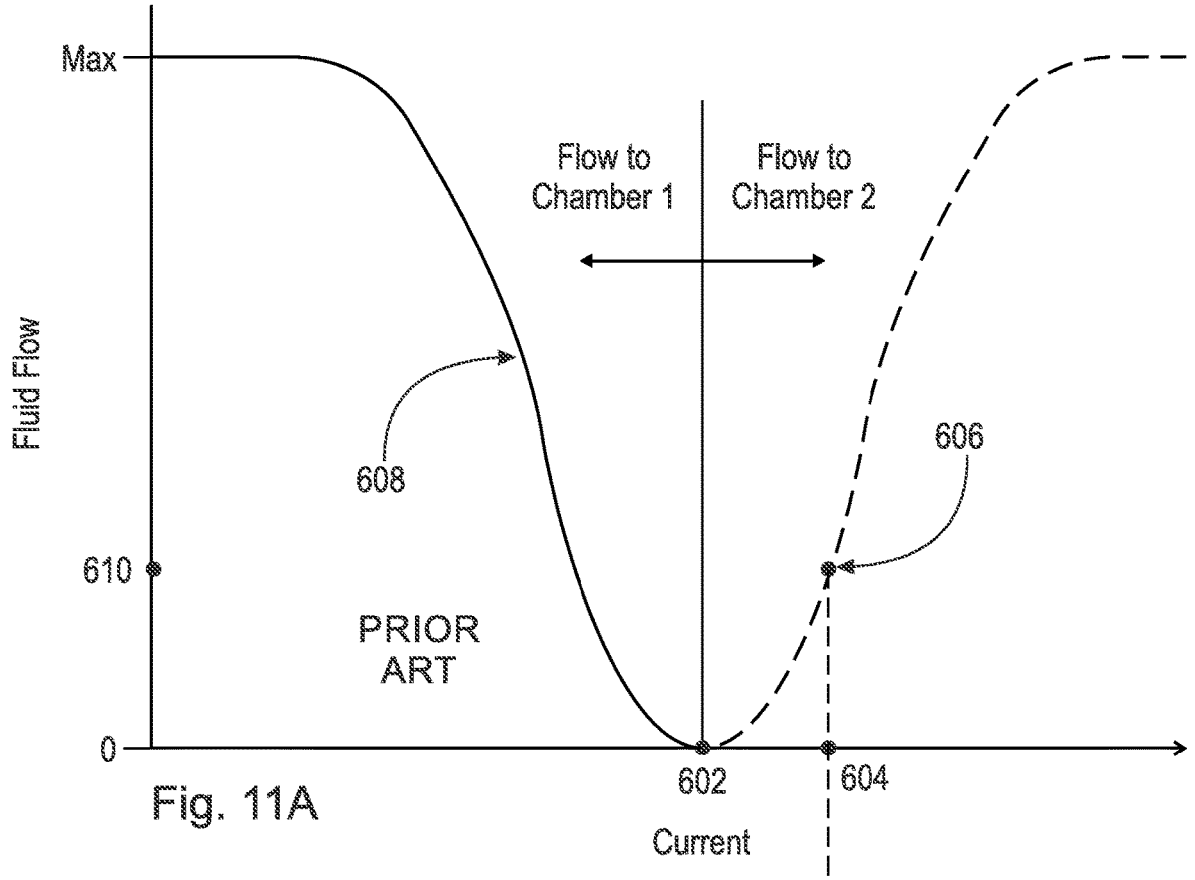
FIG. 11A is a graph of fluid flow versus electrical current for a known cam shaft phaser with an axially displaceable locking pin.
Figure 11B:
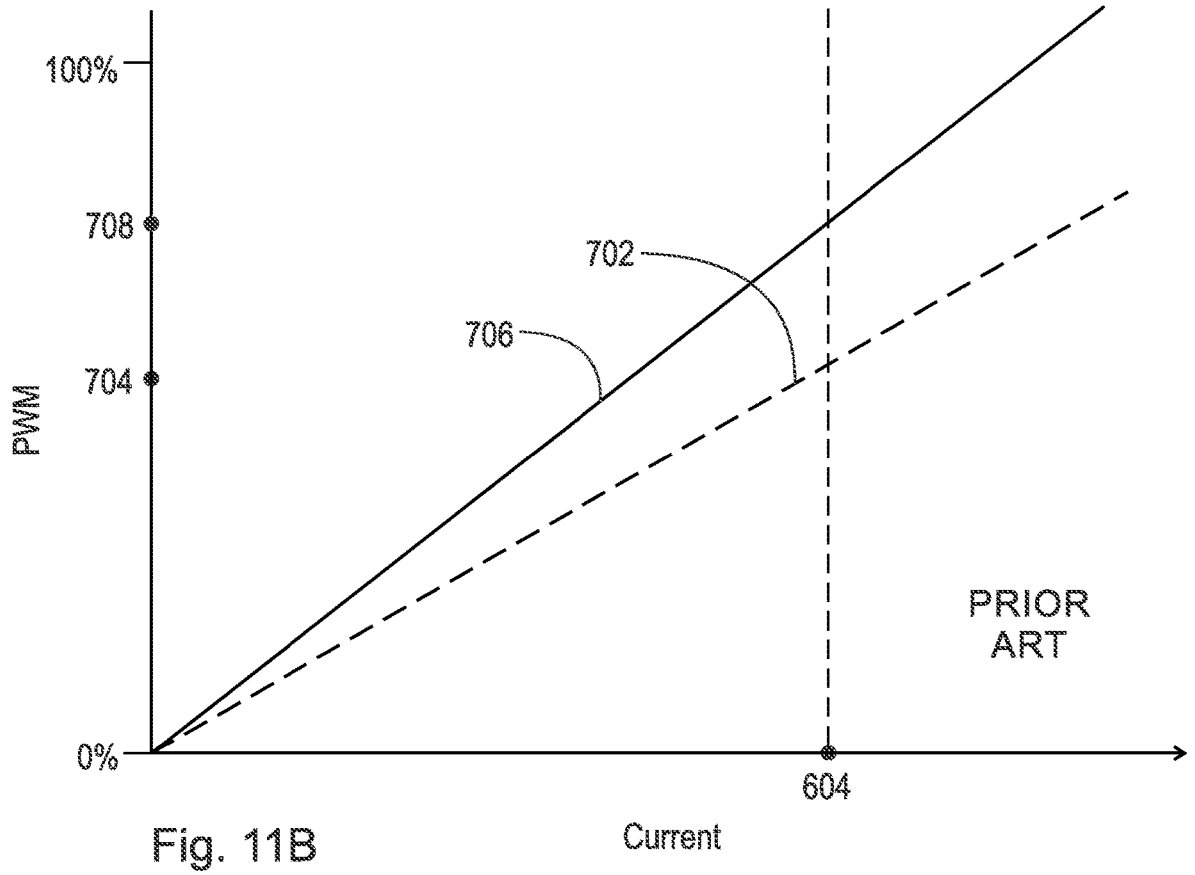
FIG. 11B is a graph of pulse width modulation (PWM) voltage versus electrical current for the cam shaft phaser of FIG. 11A.
Figure 12A:
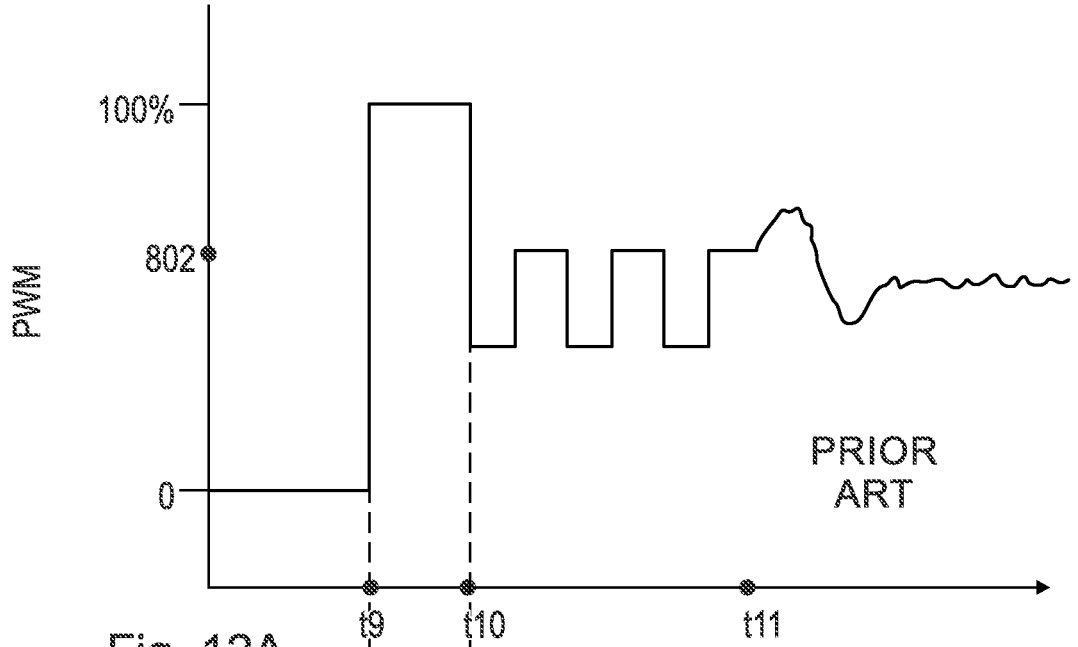
FIG. 12A is a graph of a duty cycle of PWM voltage versus time for a known method of operating a known cam shaft phaser with an axially displaceable locking pin.
Figure 12B:
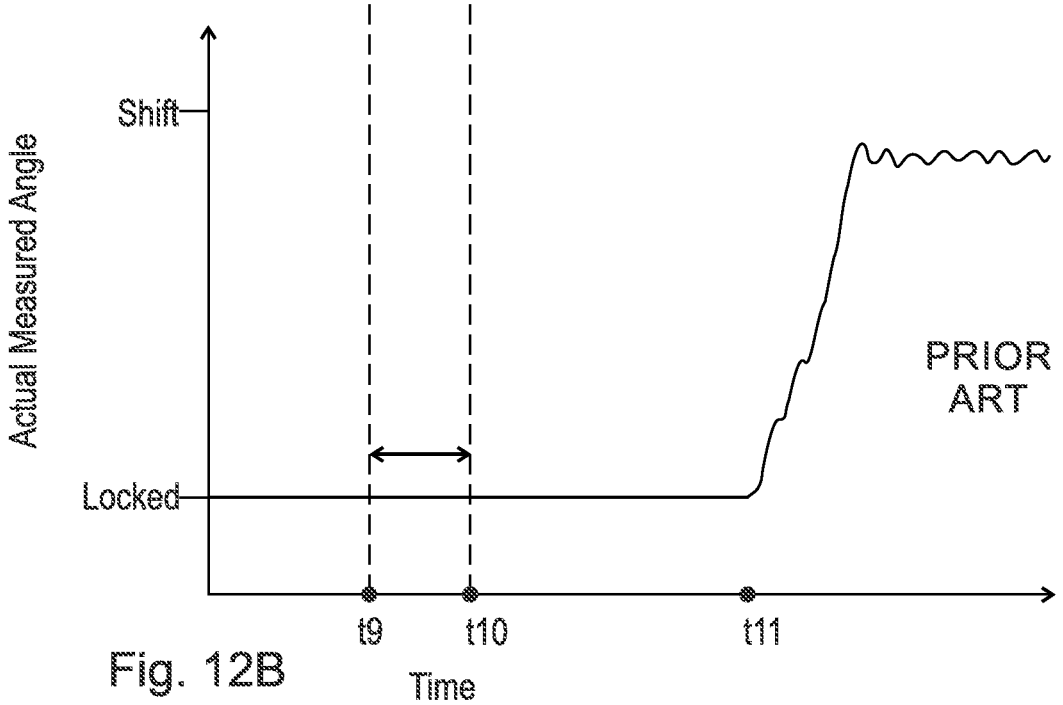
FIG. 12B is a graph of measured angle versus time for the known method of operating the known cam shaft phaser of FIG. 12A.

FIG. 10 is flow chart 500 for a method of operating a cam shaft phaser with an axially displaceable locking pin. In the discussion that follows, cam shaft phaser 100 is used as an example of the known cam shaft phaser with the axially displaceable locking pin. Although the method is presented as a sequence of steps for clarity, no order should be inferred from the sequence unless explicitly stated. The cam shaft phaser includes: a stator, for example stator 102, including a radially inwardly extending protrusion, for example protrusion 110A; a rotor, for example rotor 104 including a radially outwardly extending protrusion, for example protrusion 112A, and a slot, for example slot 118, in the radially outwardly extending protrusion; a cover, for example cover 106, non-rotatably connected to the stator; a chamber, for example chamber 114A circumferentially bounded by the radially inwardly extending protrusion and the radially outwardly extending protrusion; a pin, for example pin 120, disposed in the slot; and a first channel, for example channel 126, connecting the chamber with the slot. Step 502 blocks, with the locking pin, rotation of the rotor with respect to the stator. Step 504 applies first PWM voltage to a control valve. Step 506 flows fluid from the control valve to the chamber. Step 508 urges, with the fluid, the rotor in a first circumferential direction with respect to the stator. Step 510 axially fixes the locking pin, through contact of the locking pin with the cover, while the locking pin is blocking rotation of the rotor with respect to the stator. Step 512 applies a second PWM voltage to the control valve as a function for a duty cycle for the second PWM voltage, the function being a non-rectangular wave form increasing the duty cycle for the second PWM voltage with time. Step 514 flows the fluid through the channel to the slot. Step 516 axially displaces the locking pin with the fluid. Step 518 disengages the locking pin from the cover. Step 520 rotates the rotor with respect to the stator in the first circumferential direction.

Methods described in FIGS. 6A through 10 above address the problem noted above of transitioning from a locked mode for a cam shaft phaser to an unlocked mode for the cam shaft phaser under a range of ambient temperature conditions. That is, as noted above, known methods of transitioning from a locked mode to an unlocked mode for a cam shaft phaser, such as phaser 100, are dependent upon the ambient temperature of a control valve and are effective only for a narrow range of ambient temperatures. However, function 202 is effective for a wide range of ambient temperatures and can be implemented as needed to accommodate a particular range of ambient temperatures.

For example referring to FIGS. 1 through 7: at time t1, and at a first ambient temperature for control valve CV, PWM voltage is applied to control valve CV, and fluid F disengages locking pin 120 from cover 106, without jamming pin 120 against cover 106, at a first point in the function, for example point 204; and at time t1 and at a second, higher, ambient temperature for control valve CV, PWM voltage is applied to control valve CV and fluid F disengages locking pin 120 from cover 106, without jamming pin 120 against cover 106, at a second point in the function, the second point different from the first point, for example point 206 at time t4. Since the first ambient temperature is less than the second ambient temperature, a greater duty cycle for PWM voltage is required for the second ambient temperature to attain the desired current for control valve CV. Thus, point 206 occurs after point 204 in function 202. Stated in the inverse, since the first ambient temperature is less than the second ambient temperature, a lesser duty cycle for PWM voltage is required for the first ambient temperature to attain the desired current for control valve CV. Thus, point 204 occurs prior to point 206 in function 202.

Referring to FIG. 6A to illustrate the independence of function 202 from ambient temperature, assume that for the first ambient temperature, the locking pin disengages at point 204 and time t2. Then, for the higher second ambient temperature, the locking pin disengages at higher point 206 and time t4, still within function 202. The duration of function 202 is selectable to accommodate any variety of possible ambient temperatures. For example, extending the temporal duration of function 202 increases the range of ambient temperatures for which function 202 is effective. Therefore, regardless of the ambient temperature of control valve CV, the ideal current for displacing the locking pin is provided by function 202.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
RD1 radial direction
RD2 radial direction
CD1 circumferential direction
CD2 circumferential direction
R radius
12 object
13 object
14 object
15A surface
15B surface
15C edge
16A surface
16B edge
17A radius
17B radius
18 surface
19 circumference
20 radius
AR axis of rotation
C controller
CK crankshaft
CS cam shaft
E engine
F fluid
L1 reference line
PS power supply
PWM pulse width modulation
T torque
t1-t11 point in time
100 prior art cam shaft phaser
102 stator
104 rotor
106 cover
108 cover
110 radially inwardly extending protrusion
110A radially inwardly extending protrusion
112 radially outwardly extending protrusion
112A radially outwardly extending protrusion
114 advance chamber
114A advance chamber
116 retard chamber
116A retard chamber
118 slot
120 locking pin

122 spring
124 indentation
126 channel
128 central opening
130 channel, chamber 114
132 channel, chamber 116
202 function of duty cycle
204 point in function 202
206 point in function 202
602 electric current level
604 ideal electric current level
606 point on curve 608
608 oil flow curve
610 flow rate
702 current vs PWM line
704 PWM level
706 current vs PWM line
708 PWM level
802 PWM duty cycle

The invention claimed is:

1. A method of operating a cam shaft phaser including a stator including a radially inwardly extending protrusion, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a locking pin disposed in the slot, and a first channel connecting the chamber with the slot, the method comprising:

blocking, with the locking pin, rotation of the rotor with respect to the stator;

applying pulse width modulation (PWM) voltage to a control valve as a non-rectangular wave form;

flowing fluid from the control valve to the chamber;

flowing the fluid through the first channel to the slot;

axially displacing the locking pin with the fluid;

disengaging the locking pin from the cover; and, rotating the rotor with respect to the stator.

2. The method of claim 1, further comprising:

urging, with a spring disposed in the slot, the locking pin in a first axial direction; and, displacing, with the spring, the locking pin in the first axial direction into an indentation in the cover.

3. The method of claim 1, further comprising:

urging, with a spring disposed in the slot, the locking pin in a first axial direction, wherein axially displacing the locking pin with the fluid includes:

displacing the locking pin in a second axial direction opposite the first axial direction; and, compressing the spring.

4. The method of claim 1, further comprising:

generating, with a controller, a circumferential position of the rotor with respect to the stator;

disengaging the locking pin from the cover at a first point in the non-rectangular wave form; and, rotating the rotor to the circumferential position at a second point in the non-rectangular wave form, the second point occurring after the first point in the non-rectangular wave form.

5. The method of claim 1, wherein the non-rectangular wave form is a linear non-rectangular wave form.

6. The method of claim 1, wherein the non-rectangular wave form is a ramp non-rectangular wave form.

7. The method of claim 1, wherein the non-rectangular wave form continuously increases with time.

8. The method of claim 1, wherein flowing the fluid from the control valve to the chamber includes flowing the fluid at a rate proportional to a duty cycle for the PWM voltage.

9. The method of claim 1, further comprising:

initiating the non-rectangular wave form at a first point for the non-rectangular wave form;

terminating the non-rectangular wave form at a second point in the non-rectangular wave form; and, disengaging the locking pin from the cover at a third point in the non-rectangular wave form between the first and second points.

10. The method of claim 1, wherein:

flowing the fluid from the control valve to the chamber includes flowing the fluid through a second channel connecting the chamber with a central opening for the rotor; and, an axis of rotation for the cam shaft phaser passes through the central opening.

11. The method of claim 1, further comprising:

rotating the stator with torque from a crankshaft of an internal combustion engine.

12. A method of operating a cam shaft phaser including a stator including a radially inwardly extending protrusion, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a locking pin disposed in the slot, and a channel connecting the chamber with the slot, the method comprising:

blocking, with the locking pin, rotation of the rotor with respect to the stator;

applying first pulse width modulation (PWM) voltage to a control valve;

flowing fluid from the control valve to the chamber;

urging, with the fluid, the rotor in a first circumferential direction with respect to the stator;

axially fixing the locking pin, through contact of the locking pin with the cover, while the locking pin is blocking rotation of the rotor with respect to the stator;

applying second pulse width modulation (PWM) voltage to the control valve as a non-rectangular wave form;

flowing the fluid through the channel to the slot;

axially displacing the locking pin with the fluid;

disengaging the locking pin from the cover; and, rotating the rotor with respect to the stator in the first circumferential direction.

13. The method of claim 12, further comprising:

draining at least a portion of the fluid from the chamber after terminating the second PWM voltage.

14. The method of claim 12, wherein applying the first PWM voltage to the control valve includes applying the first PWM voltage as a rectangular wave form.

15. The method of claim 12, further comprising:

urging, with a spring disposed in the slot, the locking pin in a first axial direction; and, displacing, with the spring, the locking pin in the first axial direction into an indentation in the cover, wherein axially displacing the locking pin with the fluid includes:

displacing, with the fluid, the locking pin in a second axial direction, opposite the first axial direction; and, compressing the spring.

16. The method of claim 12, wherein applying the second PWM voltage to the control valve as the non-rectangular wave form includes:

applying, with the control valve being at a first ambient temperature, the second PWM voltage to the control valve, and disengaging the locking pin at a first point in the non-rectangular wave form; or;

applying, with the control valve being at a second ambient temperature, the second PWM voltage to the control valve, and disengaging the locking pin at a second point in the non-rectangular wave form.

17. A method of operating a cam shaft phaser including a stator including a radially inwardly extending protrusions, a rotor including a radially outwardly extending protrusion and a slot in the radially outwardly extending protrusion, a cover non-rotatably connected to the stator, a chamber circumferentially bounded by the radially inwardly extending protrusion and the radially outwardly extending protrusion, a locking pin disposed in the slot, and a first channel connecting the chamber with the slot, the method comprising:

engaging the cover with the locking pin;

blocking, with the locking pin, rotation of the rotor with respect to the stator; and, applying, at a first ambient temperature for a control valve, pulse width modulation (PWM) voltage to the control valve as a non-rectangular wave form, flowing fluid from the control valve to the chamber, flowing the fluid through the first channel to the slot, axially displacing the locking pin with the fluid, disengaging the locking pin from the cover at a first point in the non-rectangular wave form, and rotating the rotor with respect to the stator; or, applying, at a second ambient temperature for the control valve, different from the first ambient temperature, the PWM voltage to the control valve as the non-rectangular wave form, flowing the fluid from the control valve to the chamber, flowing the fluid through the first channel to the slot, axially displacing the locking pin with the fluid, disengaging the locking pin from the cover at a second point in the non-rectangular wave form, different from the first point, and rotating the rotor with respect to the stator.

18. The method of claim 17, wherein:

the first ambient temperature is less than the second ambient temperature; and, the first point occurs prior to the second point in the non-rectangular wave form.

* * * * *